US008214932B2

(12) United States Patent
Shannon

(10) Patent No.: US 8,214,932 B2
(45) Date of Patent: Jul. 10, 2012

(54) AUTOMATIC SELF-CLOSING TOILET SEAT ASSEMBLY

(75) Inventor: Daniel E. Shannon, Loveland, CO (US)

(73) Assignee: Smart Lid, LLC, Sterling, VA (US)

( * ) Notice: Subject to any disclaimer, the term of this patent is extended or adjusted under 35 U.S.C. 154(b) by 579 days.

(21) Appl. No.: 12/378,106

(22) Filed: Feb. 11, 2009

(65) Prior Publication Data

US 2010/0199414 A1 Aug. 12, 2010

(51) Int. Cl.
*A47K 13/12* (2006.01)

(52) U.S. Cl. ..... 4/236; 4/235; 4/240; 4/241; 4/248

(58) Field of Classification Search ..... 4/235, 236, 4/240, 241, 248
See application file for complete search history.

(56) References Cited

U.S. PATENT DOCUMENTS

| | | | | |
|---|---|---|---|---|
| 4,912,783 | A * | 4/1990 | Shafer | 4/246.1 |
| 5,142,740 | A * | 9/1992 | Amaki et al. | 16/381 |
| 5,852,831 | A * | 12/1998 | Naughton et al. | 2/236 |
| 6,182,301 | B1 * | 2/2001 | Krueger et al. | 4/248 |
| 6,523,185 | B1 * | 2/2003 | Moore et al. | 4/246.2 |
| 6,751,826 | B2 * | 6/2004 | Miller | 16/262 |
| 6,775,855 | B1 | 8/2004 | Shannon | 4/246.2 |
| 7,150,049 | B1 * | 12/2006 | Fitch | 4/246.1 |
| 7,296,664 | B2 * | 11/2007 | Ohta et al. | 188/294 |
| 7,845,027 | B2 * | 12/2010 | Er et al. | 4/236 |
| 2008/0271230 | A1 * | 11/2008 | Laundre | 4/236 |
| 2010/0223718 | A1 * | 9/2010 | Andersen | 4/240 |
| 2011/0000010 | A1 * | 1/2011 | Henne | 4/236 |

FOREIGN PATENT DOCUMENTS

| | | |
|---|---|---|
| GB | 2 376 476 | 12/2002 |
| WO | WO 91/12760 | 9/1991 |

OTHER PUBLICATIONS

United States Patent Application Publication No. US2008/0010733 published Jan. 17, 2008 (Kenneth E. Lambert).
International Search Report and Written Opinion, Corresponding to International Application No. PCT/US2010/023610, Mailed Apr. 7, 2010.

* cited by examiner

*Primary Examiner* — Brian Glessner
*Assistant Examiner* — Joshua Ihezie
(74) *Attorney, Agent, or Firm* — Muncy, Geissler, Olds & Lowe, PLLC

(57) ABSTRACT

A self-closing toilet seat assembly includes a longitudinal hinge tube mounted in a cavity on the underside of a toilet lid in coaxial alignment with the hinge flanges thereof. The hinge tube is secured in hinged engagement with both the toilet lid and seat by means of a pair of slow-close hinge dampeners. A self-closing mechanism, in association with a mounting base attached to the bowl of a conventional toilet and to the underside of the hinge tube, is responsive to manual lifting of either the toilet lid itself or of both the toilet lid and the toilet seat to the open or vertical position for initiating closing rotation of the toilet lid and the toilet seat, if also upright, to the vertical tipping point, past which they continue to gravitationally rotate to the closed position, at a rate limited by the slow-close hinge dampeners. The self-closing mechanism is responsive to the weight of a user seated on the toilet seat for inhibiting closing rotation of the toilet lid until the user rises from the toilet seat.

4 Claims, 5 Drawing Sheets

AUTOMATIC SELF-CLOSING TOILET SEAT ASSEMBLY

BACKGROUND AND SUMMARY OF THE INVENTION

This invention relates generally to self-closing toilet seats and, more particularly, to a self-lowering toilet seat assembly whose self-lowering operation is automatically initiated and does not require any type of manual actuation by the user.

Various types of self-closing or self-lowering toilet seats are known in the prior art. U.S. Pat. No. 6,775,875 to the present inventor is directed to a self-closing toilet lid that employs a water reservoir in the lid and a complex mechanism whose closing operation must be initiated manually by the user. U.S. Patent Application Publication No. US 2008/0010733 to Lambert is directed to a self-lowering toilet seat that relies on the atmosphere for operation and that allows the seat to fall uncontrolled onto the toilet bowl below.

It would be advantageous to provide a self-closing toilet seat assembly which automatically rotates the lid to the vertical tipping position a predetermined time after it has been lifted to the open position by the user. Closing of the lid and the seat, if also lifted, continues past the vertical tipping position at a controlled rate so as not to contact the toilet bowl below with the full force of free fall.

It would also be advantageous to provide a self-closing toilet seat assembly which inhibits automatic closing rotation of the toilet lid for as long as a user is seated on the toilet seat.

In accordance with the illustrated preferred embodiment of the present invention, a self-closing toilet seat assembly includes a longitudinal hinge tube mounted in a cavity on the underside of a toilet lid in coaxial alignment with the hinge flanges thereof. The hinge tube is secured in hinged engagement with both the toilet lid and seat by means of a pair of slow-close hinge dampeners. A self-closing mechanism, contained on a mounting base attached to the bowl of a conventional toilet and to the underside of the hinge tube, is responsive to manual lifting of either the toilet lid itself or of both the toilet lid and the toilet seat to the open or vertical position for initiating closing rotation of the toilet lid and the toilet seat, if also upright, to the vertical tipping point, past which they continue to gravitationally rotate to the closed position, at a rate limited by the slow-close hinge dampeners. The self-closing mechanism is responsive to the weight of a user seated on the toilet seat for inhibiting closing rotation of the toilet lid until the user rises from the toilet seat.

DESCRIPTION OF THE PREFERRED EMBODIMENT

Figure 1:
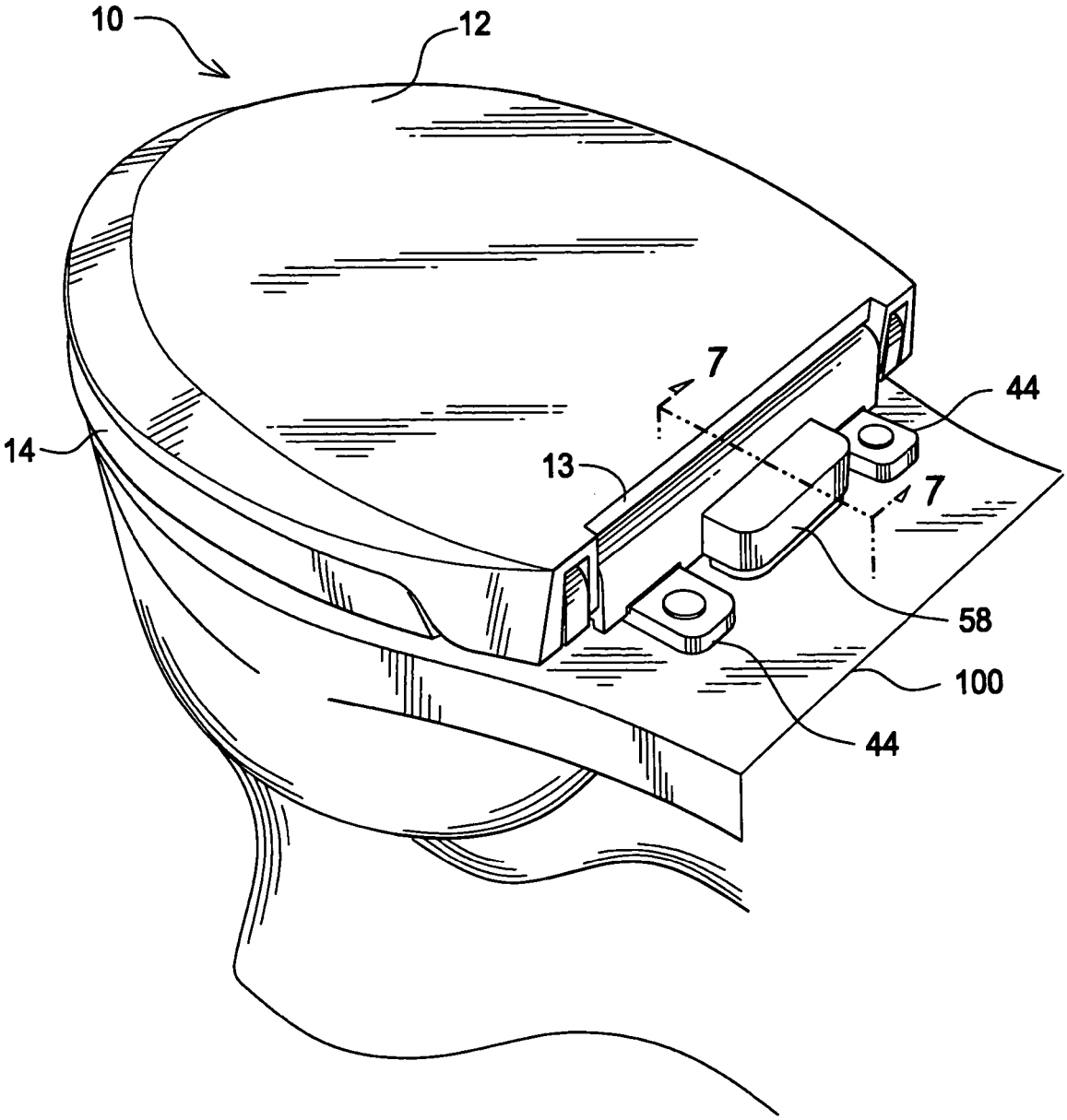
FIG. 1 is a pictorial diagram illustrating the automatic self-closing toilet seat assembly of the present invention mounted on the bowl of a conventional toilet with both the seat and lid in their lowered or closed positions.
Figure 2:
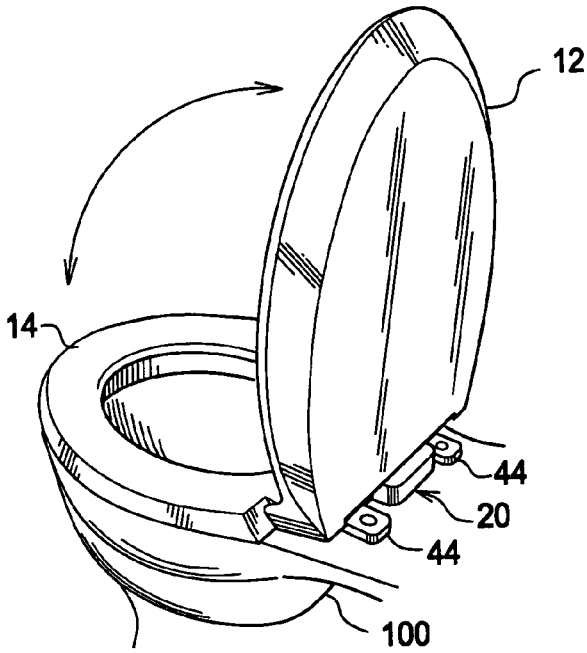
FIG. 2 is a pictorial diagram of the self-closing toilet seat assembly of FIG. 1 illustrating the seat in the lowered position and the lid in the raised or open position.
Figure 3:
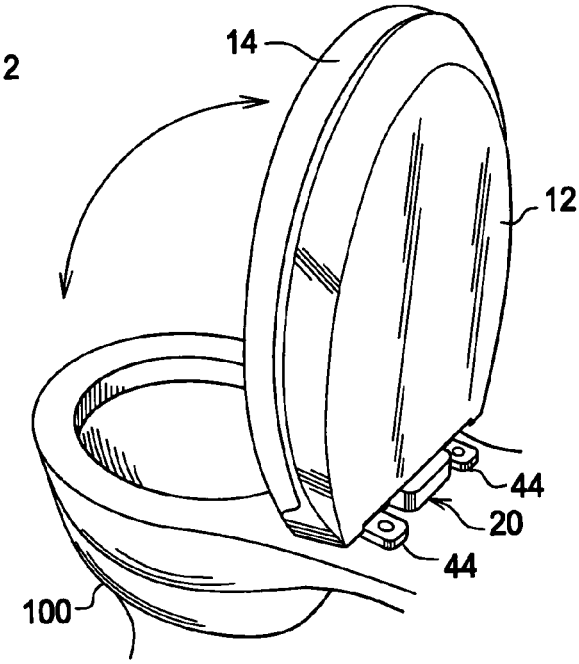
FIG. 3 is a pictorial diagram of the self-closing toilet seat assembly of FIG. 1 illustrating both the seat and the lid in the raised or open position.
Figure 10:
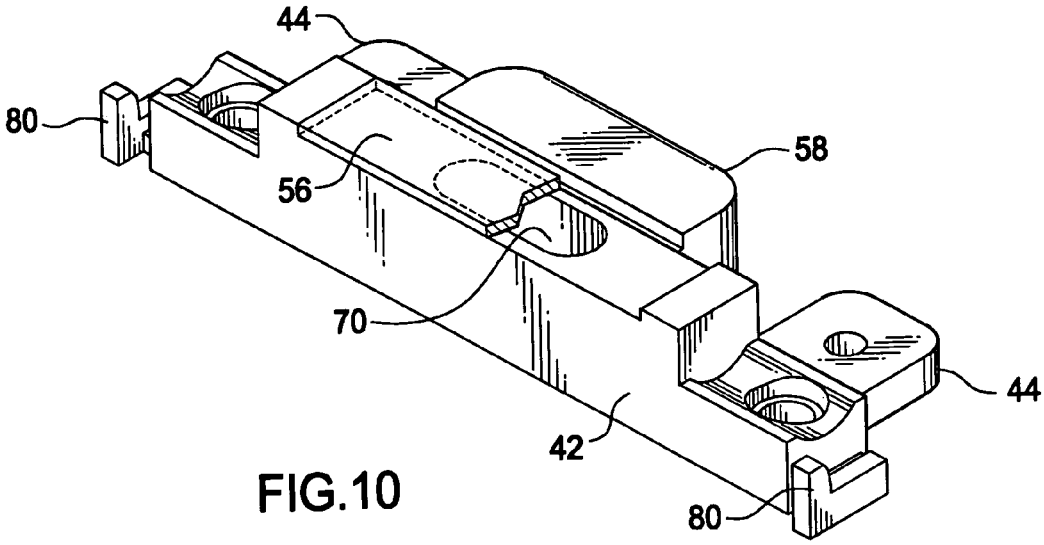
FIG. 10 is a top perspective view of the mounting base component of the self-closing mechanism of FIG. 4.
Figure 4:
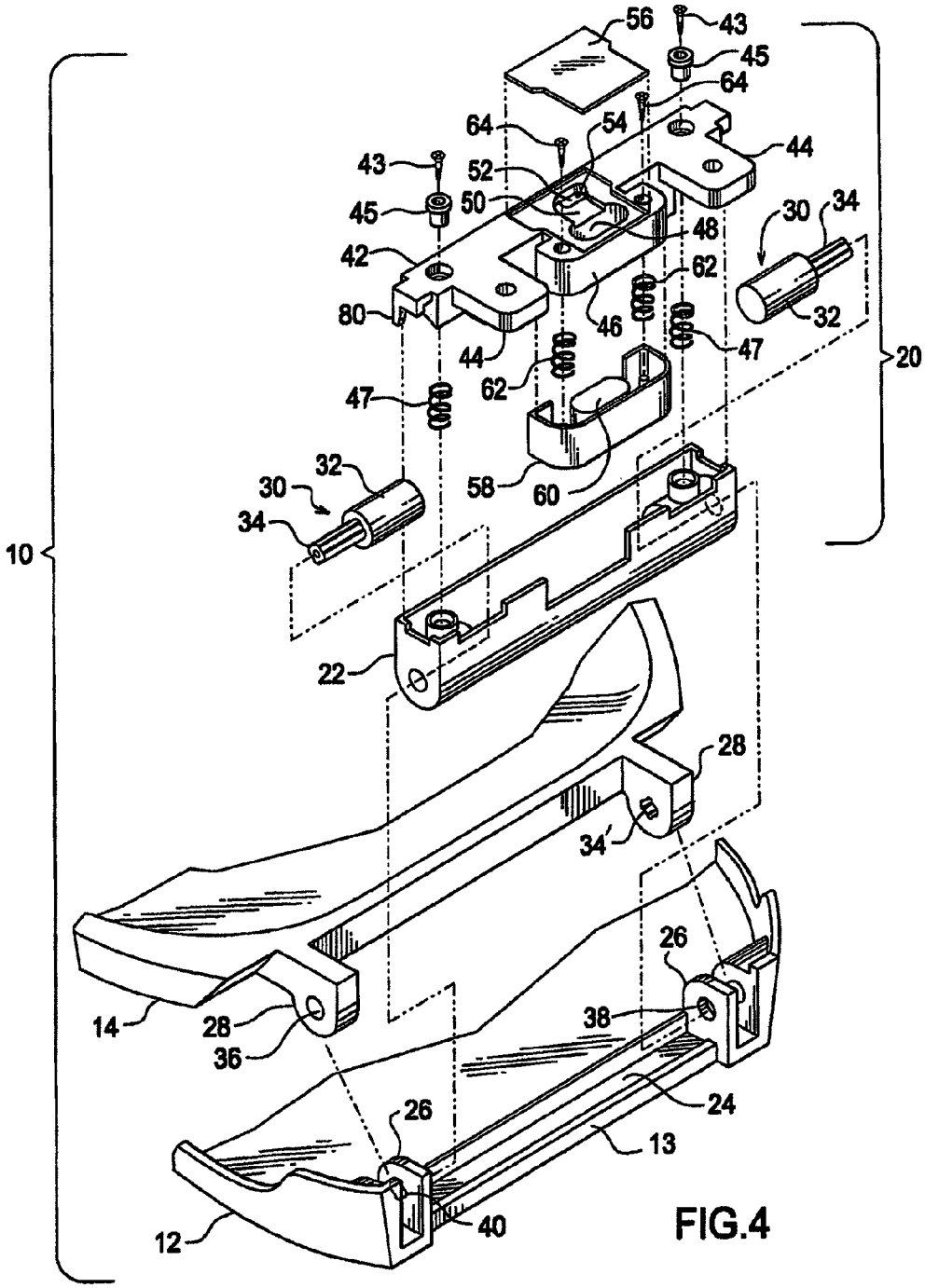
FIG. 4 is a bottom view exploded assembly diagram illustrating the self-closing mechanism of the present invention that is contained in the underside of the toilet seat assembly of FIGS. 1-3.

Referring now to FIGS. 1-3, there is shown a self-closing toilet seat assembly 10 in accordance with the present invention, hingedly mounted on a conventional toilet bowl 100. Toilet seat assembly 10 includes a hinged lid 12 and a seat 14 coaxially hinged therewith. Toilet seat assembly 10 includes a self-closing mechanism 20 that operates to automatically close lid 12 when a predetermined time period has elapsed following raising or opening thereof. In the event seat 14 was also raised in preparation for use of the toilet, both lid 12 and seat 14 will be closed in concert.

Referring additionally to FIGS. 4-10, self-closing mechanism 20 includes a hinge tube 22 that is positioned in a cavity 24 provided on the underside of lid 12 between a pair of spaced apart hinge flanges 26 formed along the rear edge of lid 12. Seat 14 is attached to lid 12 by means of a pair of spaced apart hinge flanges 28 that are aligned with and engage hinge flanges 26 of lid 12. A pair of slow-close hinge dampeners 30, each of which includes a cylindrical body portion 32 and an outwardly extending splined shaft 34, are positioned within hinge tube 22 at opposite ends thereof such that the shafts 34 pass through openings 34', 36 in the hinge flanges 28 of seat 14 and through openings 38, 40 in the hinge flanges 26 of lid 12 to secure lid 12 and seat 14 in hinged engagement with each other and with hinge tube 22. Opening 40 in the corresponding one of the hinge flanges 26 of lid 12 is grooved to engage the splined shaft 34 of the associated one of slow-close hinge dampeners 30, while opening 36 in the adjacent one of hinge flanges 28 of seat 14 has a smooth cylindrical inner surface and is slightly larger in diameter than the diameter of the splined shaft 34 of the associated one of slow-close hinge dampeners 30 to prevent engagement therewith. Opening 34' in the other one of the hinge flanges 26 of seat 14 is grooved to engage the splined shaft 34 of the associated one of slow-close hinge dampeners 30, while opening 38 in the adjacent one of hinge flanges 26 of lid 12 has a smooth cylindrical inner surface and is slightly larger in diameter than the diameter of the splined shaft 34 of the associated one of slow-close hinge dampeners 30 to prevent engagement therewith.

Figure 6:
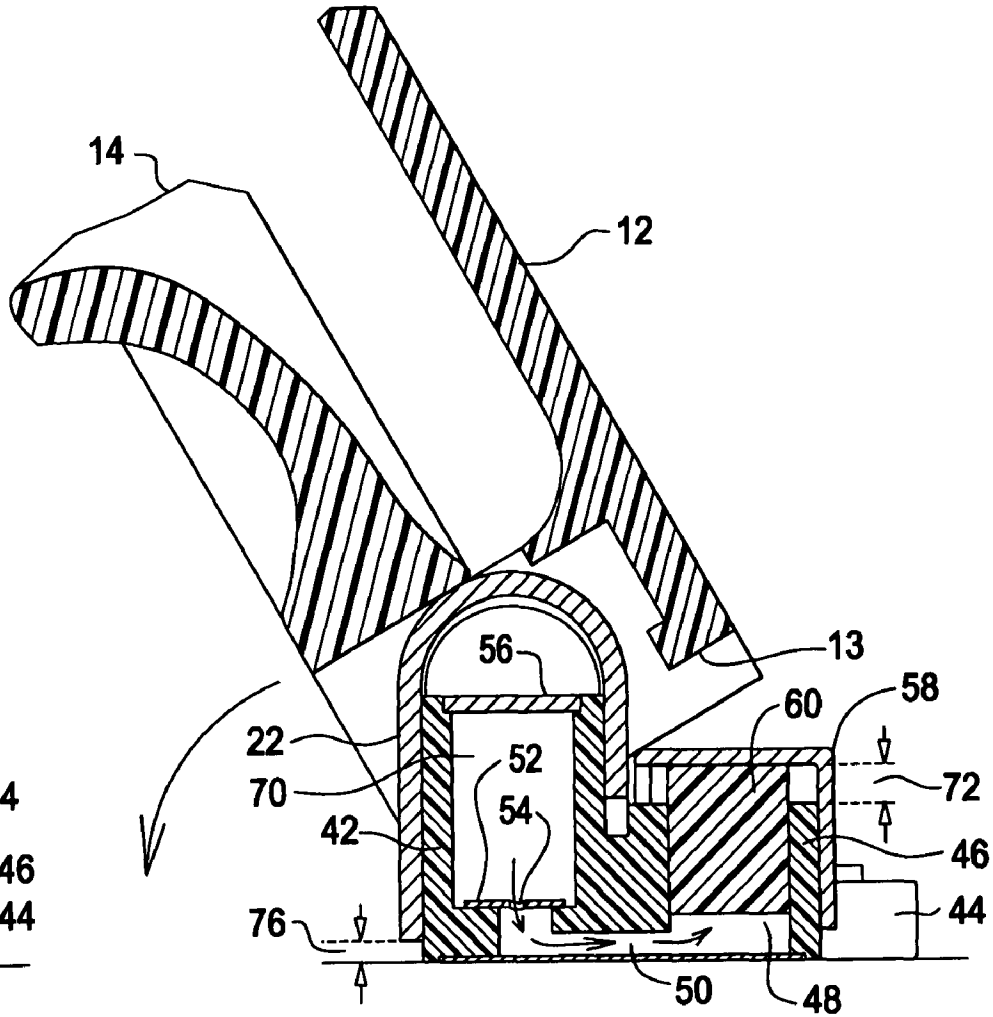
FIG. 6 is a cross-sectional view of the self-closing mechanism of FIG. 4 taken along the section line 7-7 of FIG. 1, with both the toilet seat and lid moving toward the lowered or closed position illustrated in FIG. 1.
Figure 5:
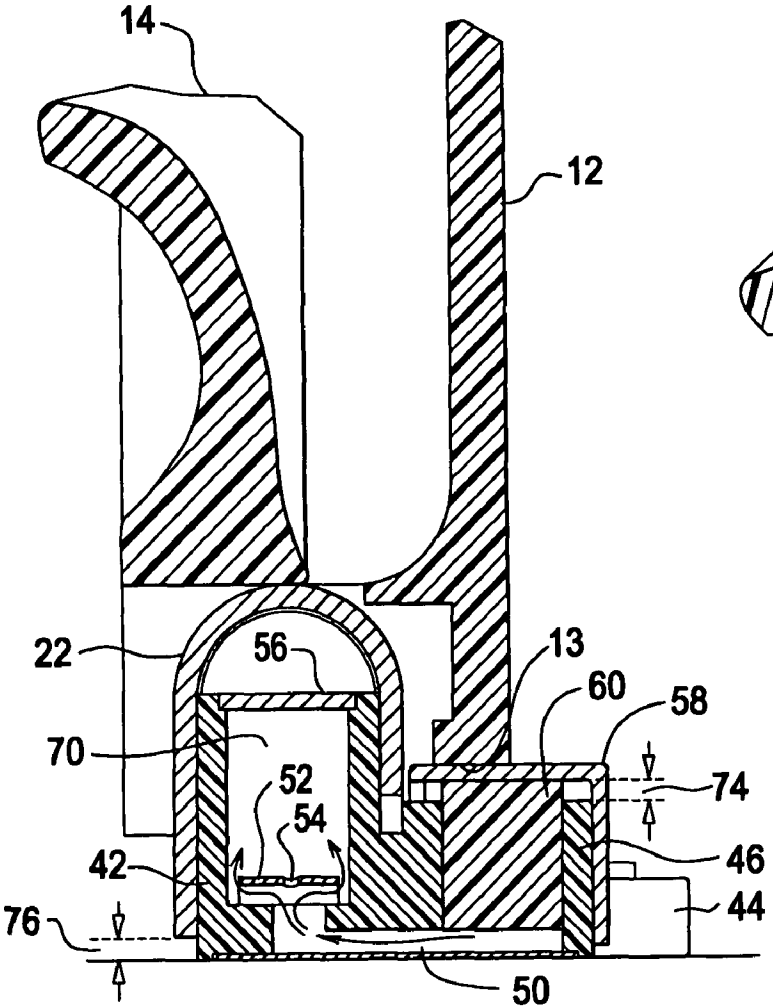
FIG. 5 is a cross-sectional view of the self-closing mechanism of FIG. 4 taken along the section line 7-7 of FIG. 1, with both the toilet seat and lid in the raised or open position illustrated in FIG. 3.
Figure 7:
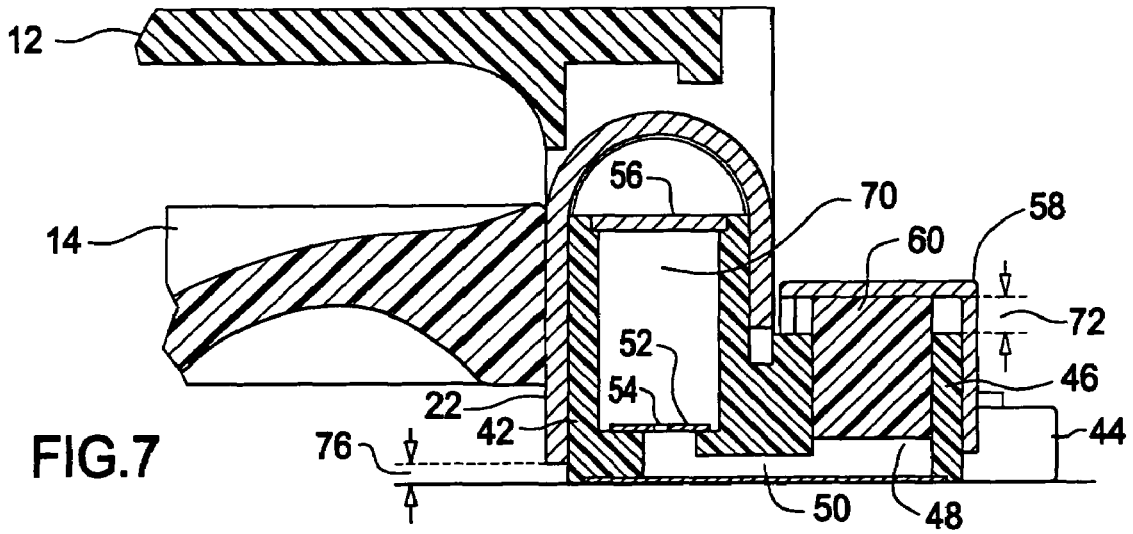
FIG. 7 is a cross-sectional view of the self-closing mechanism of FIGS. 1 and 4 taken along the section line 7-7 of FIG. 1, with both the toilet seat and lid in the lowered or closed position illustrated in FIG. 1.
Figure 8:
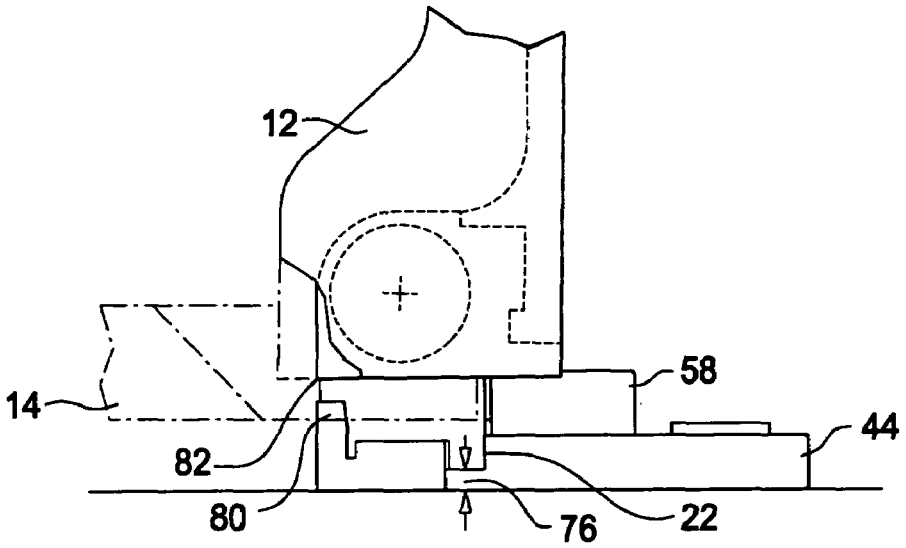
FIG. 8 is a side view of the self-closing toilet seat assembly of FIGS. 1-3 illustrating the relative positions of the seat, lid, and mounting base components thereof when the lid is in the raised position and the seat is in the lowered position without the weight of a user seated thereon.

Slow-close hinge dampeners 30 operate to limit the rate of rotation of their shafts 34 in response to a rotational force applied thereto with respect to the body portions 32 thereof that are fixedly mounted within hinge tube 22. Slow-close hinge dampeners may be of the type manufactured and sold by Bayen (Xiamen) Sanitary Ware Co., Ltd of Xiamen, China. A mounting base 42 serves as a cover for hinge tube 22 and also to provide attachment of the self-closing toilet seat assembly 10 to bowl 100 by means of two rearwardly-protruding mounting tabs 44. Mounting base 42 is attached over hinge tube 22 by means of a pair of screws 43, a pair of inserts 45, and a pair of hinge tube suspension springs 47. This arrangement serves to suspend hinge tube 22 approximately five millimeters above mounting base 22 in the absence of downward pressure on seat 14 that is typically imposed by a user being seated thereon. A rearwardly-protruding extension 46 of mounting base 42, centrally positioned along the length thereof, includes a central elliptical cylinder cavity 48 that communicates with a fluid passageway 50 recessed in the bottom surface of mounting base 42. A reed valve 52 is positioned in an opening in fluid passageway 50 proximate the front edge of mounting base 42. A timing orifice 54 is provided in reed valve 52. While the size of timing orifice 54 may be varied as desired, an orifice of approximately two millimeters in diameter has been found to be suitable. A flat cover 56 is mounted over a correspondingly-shaped recess formed in the bottom surface of mounting base 42 to enclose fluid passageway 50. A piston cap 58 is shaped in correspondence with rearwardly-protruding extension 46 of mounting base 42 and includes a piston 60 that is aligned with cylinder cavity 48. Piston cap 58 is mounted over rearwardly-protruding extension 46 of mounting base 42 such that piston 60 resides within cylinder cavity 48 in sliding engagement therewith. Mounting of piston cap 58 is accomplished by means of a pair of screws 64 and a pair of piston pushing springs 62 that serve to urge piston cap 58 upwardly away from extension 46 of mounting base 42, resulting in a quiescent space or distance 72 therebetween, as shown in FIGS. 6 and 7. A fluid reservoir 70 within mounting base 42 is centrally positioned along the length thereof adjacent piston cap 58. Fluid reservoir 70 communicates with fluid passageway 50 on the underside of mounting base 42 and opens to the top of mounting base 42. A removable cover 56 permits access to fluid reservoir 70. Fluid reservoir 70 is initially filled with a commercially available viscous fluid such a Dow Coming High Vacuum Grease.

The user commences operation of the automatic self-closing toilet assembly 10 of the present invention by raising only lid 12 or both lid 12 and seat 14 in preparation for use of the toilet. When lid 12 is raised to a point approximately 50 degrees above the horizontal, rear edge 13 thereof contacts the top surface of piston cap 58 and begins pushing piston cap 58 downward against the upward force of piston pushing springs 62, thereby causing piston 60 to force fluid from cylinder cavity 48, through fluid passageway 50, around reed valve 52 which opens as a result of the upward pressure of the fluid against it, and into fluid reservoir 70, as illustrated by the fluid flow arrows shown in FIG. 5. When lid 12 has been raised to its fully open or vertical position, the flow of fluid in fluid reservoir 70 stops, and reed valve 52 closes. At this point, the upward force produced by pushing springs 62 is slowly released by the flow of fluid in the reverse direction from fluid reservoir 17 through timing orifice 54, then through fluid passageway 50, and back into cylinder cavity 48. This slow release of the tension of pushing springs 62 produces upward movement of piston cap 58 against rear edge 13 of lid 12, thereby rotating lid 12 and seat 14, if also upright, past the vertical tipping point. The rate at which piston cap 58 is permitted to move upward following opening of lid 12 is controlled by the size of orifice 54 in reed valve 52. It has been found that an orifice diameter of approximately two millimeters results in delaying rotation of lid 12 to the vertical tipping point approximately two minutes to accommodate normal use of the toilet. When the lid 12 and seat 14, if also upright, pass the vertical tipping point, they are permitted to close by gravity, but slowed by the rotational dampening action provided by slow-close hinge dampeners 30.

Figure 9:
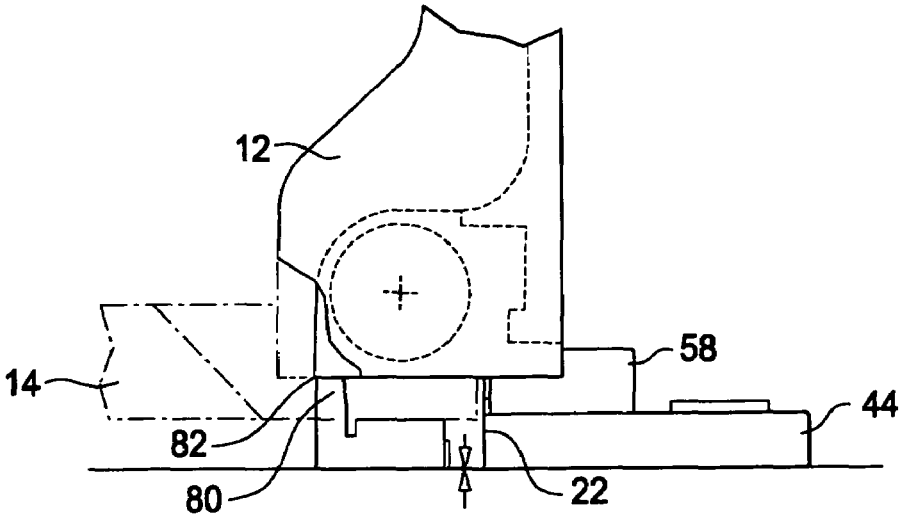
FIG. 9 is a side view of the self-closing toilet seat assembly of FIGS. 1-3 illustrating the relative positions of the seat, lid, and mounting base components thereof when the lid is in the raised position and the seat is in the lowered position, in the presence of weight on the seat resulting from a user being seated thereon.

In the event the user is seated on seat 14, it is, of course, desirable to further delay closing rotation of lid 12 until the user rises from seat 14. As stated above, in the absence of weight on seat 14, hinge tube 22 is suspended approximately five millimeters above mounting base 22, as represented by distance 76 in FIGS. 5-8. That distance is sufficient to allow the corners 82 of each of the hinge flanges 26 of lid 12 to rotate past the top surface of a vertical finger 80 provided on each end of mounting base 42, without interference therebetween, as may be understood with reference to FIGS. 4, 8, and 10. However, the weight of a user on seat 14 results in compression of the hinge tube compression springs 47 such that the distance 76 illustrated in FIG. 5-8 is eliminated, as illustrated in FIG. 9. Under this condition, corners 82 of hinge flanges 26 interfere with the top surface of vertical fingers 80 so as to prevent closing rotation of lid 12 until such time as the user rises from seat 14.

I claim:

1. A self-closing toilet seat assembly for attachment over the bowl of a conventional toilet, comprising:

a toilet lid having a pair of spaced apart hinge flanges on an underside thereof proximate a rear edge thereof, each of said spaced apart hinge flanges having a central opening therein, said toilet lid having a longitudinal hinge tube cavity on the underside thereof between said pair of spaced apart hinge flanges;

a toilet seat having a pair of rearwardly extending spaced apart hinge flanges, each having a central opening therein, said spaced apart hinge flanges of said toilet seat being positioned for axial alignment of said central openings therein with said central openings in said pair of spaced apart hinge flanges of said toilet lid;

a longitudinal hinge tube having first and second end faces, each of said end faces having a central opening therein, said hinge tube residing in said hinge tube cavity of said toilet lid;

a pair of slow-close hinge dampeners, each having an inwardly extending body portion and an outwardly extending splined shaft, said slow-close hinge dampeners being operative for limiting a rate of rotation of their shafts in response to a rotational force applied thereto with respect to their body portions, said slow-close hinge dampeners being positioned within said hinge tube at opposite ends thereof, said body portion of each of said slow-close hinge dampeners being fixedly mounted within said hinge tube, said outwardly extending shaft portion of each of said slow-close hinge dampeners extending outwardly through respective ones of said central openings in said end faces of said hinge tube, through respective ones of said central openings in said hinge flanges of said toilet seat, and through respective ones of said central openings in said hinge flanges of said toilet lid for securing said toilet lid and said toilet seat in hinged engagement with each other and with said hinge tube; and a mounting base attached to an underside of said hinge tube, said mounting base having a pair of rearwardly-protruding mounting tabs for attachment of said self-closing toilet seat assembly to said bowl of a conventional toilet;

said central opening in one of said hinge flanges of said toilet lid having an inner grooved surface for engaging the splined shaft of an associated first one of said slow-close hinge dampeners, said central opening in an adjacent one of said hinge flanges of said toilet seat having a smooth inner surface that does not engage the splined shaft of said first one of said slow-close hinge dampeners; and said central opening in the other one of said hinge flanges of said toilet seat having an inner grooved surface for engaging the splined shaft of an associated second one of said slow-close hinge dampeners, said central opening in an adjacent one of said hinge flanges of said toilet lid having a smooth inner surface that does not engage the splined shaft of said second one of said slow-close hinge dampeners;

said self-closing toilet seat assembly further comprising a self-closing mechanism in association with said mounting base, said self-closing mechanism being responsive to manual lifting of only said toilet lid or of both said toilet lid and said toilet seat to an open vertical position in preparation for use of the toilet, for initiating closing rotation of said toilet lid and said toilet seat, if also upright, to a vertical tipping point, past which said toilet lid and said toilet seat, if also upright, continue to gravitationally rotate, at a rate limited by said slow-close hinge dampeners, to a lowered or closed position, said self-closing mechanism being further responsive to the weight of a user seated on said toilet seat for inhibiting the initiation of closing rotation of said toilet lid until such time as the user rises from said toilet seat, said mounting base is attached to said hinge tube by means of fasteners that include a pair of hinge tube suspension springs positioned within said hinge tube proximate respective ends thereof, said suspension springs serving to suspend said hinge tube a predetermined distance above said mounting base in the absence of the weight of a user seated on said toilet seat, said suspension springs being compressed by the weight of a user seated on said toiled seat such that said predetermined distance is reduced to zero.

2. A self-closing toilet seat assembly as in claim 1, wherein said mounting base includes an upwardly protruding finger at an end thereof, said finger contacting an associated one of said hinge flanges of said toilet lid when a user is seated on said toilet seat to thereby inhibit the initiation of closing rotation of said toilet lid, said finger clearing said associated one of said hinge flanges of said toilet lid in the absence of the weight of a user on said toilet seat to thereby permit the initiation of closing rotation of said toilet lid.

3. A self-closing toilet seat assembly for attachment over the bowl of a conventional toilet, comprising:

a toilet lid having a pair of spaced apart hinge flanges on an underside thereof proximate a rear edge thereof, each of said spaced apart hinge flanges having a central opening therein, said toilet lid having a longitudinal hinge tube cavity on the underside thereof between said pair of spaced apart hinge flanges;

a toilet seat having a pair of rearwardly extending spaced apart hinge flanges, each having a central opening therein, said spaced apart hinge flanges of said toilet seat being positioned for axial alignment of said central openings therein with said central openings in said pair of spaced apart hinge flanges of said toilet lid;

a longitudinal hinge tube having first and second end faces, each of said end faces having a central opening therein, said hinge tube residing in said hinge tube cavity of said toilet lid;

a pair of slow-close hinge dampeners, each having an inwardly extending body portion and an outwardly extending splined shaft, said slow-close hinge dampeners being operative for limiting a rate of rotation of their shafts in response to a rotational force applied thereto with respect to their body portions, said slow-close hinge dampeners being positioned within said hinge tube at opposite ends thereof, said body portion of each of said slow-close hinge dampeners being fixedly mounted within said hinge tube, said outwardly extending shaft portion of each of said slow-close hinge dampeners extending outwardly through respective ones of said central openings in said end faces of said hinge tube, through respective ones of said central openings in said hinge flanges of said toilet seat, and through respective ones of said central openings in said hinge flanges of said toilet lid for securing said toilet lid and said toilet seat in hinged engagement with each other and with said hinge tube; and a mounting base attached to an underside of said hinge tube, said mounting base having a pair of rearwardly-protruding mounting tabs for attachment of said self-closing toilet seat assembly to said bowl of a conventional toilet;

said central opening in one of said hinge flanges of said toilet lid having an inner grooved surface for engaging the splined shaft of an associated first one of said slow-close hinge dampeners, said central opening in an adjacent one of said hinge flanges of said toilet seat having a smooth inner surface that does not engage the splined shaft of said first one of said slow-close hinge dampeners; and said central opening in the other one of said hinge flanges of said toilet seat having an inner grooved surface for engaging the splined shaft of an associated second one of said slow-close hinge dampeners, said central opening in an adjacent one of said hinge flanges of said toilet lid having a smooth inner surface that does not engage the splined shaft of said second one of said slow-close hinge dampeners;

said self-closing toilet seat assembly further comprising a self-closing mechanism in association with said mounting base, said self-closing mechanism being responsive to manual lifting of only said toilet lid or of both said toilet lid and said toilet seat to an open vertical position in preparation for use of the toilet, for initiating closing rotation of said toilet lid and said toilet seat, if also upright, to a vertical tipping point, past which said toilet lid and said toilet seat, if also upright, continue to gravitationally rotate, at a rate limited by said slow-close hinge dampeners, to a lowered or closed position, said self-closing mechanism being further responsive to the weight of a user seated on said toilet seat for inhibiting the initiation of closing rotation of said toilet lid until such time as the user rises from said toilet seat, said self-closing mechanism comprises a fluid reservoir centrally located along the length of said mounting base for containing a quantity of a viscous fluid, said fluid reservoir opening to top and bottom surfaces of said mounting base;

a reed valve positioned within said fluid reservoir proximate said bottom opening therein, said reed valve having a timing orifice centrally located therein, said reed valve being arranged to permit the unrestricted flow of said viscous fluid into said fluid reservoir and to restrict the flow of said viscous fluid out of said fluid reservoir to only that which passes through said timing orifice; and a recessed access cover removably positioned over said fluid reservoir opening on said top surface of said mounting base;

said mounting base including a rearwardly-protruding extension located between said mounting tabs and behind said fluid reservoir, said rearwardly-protruding extension of said mounting base including a central cylinder cavity, a bottom of said central cylinder cavity communicating with a covered fluid passageway recessed in a bottom surface of said mounting base, said fluid passageway connecting said central cylinder cavity and said fluid reservoir;

said self-closing mechanism further comprising:

a piston cap shaped in correspondence with said rearwardly-protruding extension of said mounting base, said piston cap being mounted over a top of said rearwardly-protruding extension of said mounting base by means of a pair of fasteners that include a pair of piston pushing springs that serve to urge said piston cap upwardly a predetermined quiescent distance, said piston cap including a piston shaped in correspondence with said central cylinder cavity in said rearwardly-protruding extension of said mounting base and adapted for sliding engagement within said cylinder cavity in concert with upward and downward movement of said piston cap, said piston cap being forced downward a distance equal to said predetermined quiescent distance through contact from a rear edge of said toilet lid that occurs when said toilet lid is manually lifted to its open vertical position in preparation for use of said toilet, downward movement of said piston cap being operative for forcing said viscous fluid from said cylinder cavity, through said fluid passageway, past said reed valve, and into said fluid reservoir, said piston pushing springs thereafter being operative for urging said piston cap upward, thereby slowly drawing said viscous fluid from said fluid reservoir through said timing orifice of said reed valve, through said fluid passageway, and back into said cylinder cavity, upward movement of said piston cap against said rear edge of said toilet lid, at a rate predetermined by the size of said timing orifice in said reed valve, serving to rotate said lid and said seat, if also upright, past a vertical tipping point, beyond which they are permitted to close by gravity, but slowed by the rotational dampening action provided by said slow-close hinge dampeners.

4. A self-closing toiled seat assembly as in claim 3, where said cylinder cavity and said piston are correspondingly elliptical in shape.

* * * * *